US010092467B2

(12) United States Patent
Mackert

(10) Patent No.: US 10,092,467 B2
(45) Date of Patent: Oct. 9, 2018

(54) SEATING FURNITURE CHASSIS HAVING A HEIGHT-ADJUSTMENT SEAT SURFACE

(71) Applicant: Innotec Motion GmbH, Lippstadt (DE)

(72) Inventor: Michael Mackert, Rüthen (DE)

(73) Assignee: Innotec Motion GmbH, Lippstadt (DE)

( * ) Notice: Subject to any disclaimer, the term of this patent is extended or adjusted under 35 U.S.C. 154(b) by 0 days.

(21) Appl. No.: 15/517,048

(22) PCT Filed: Jan. 6, 2016

(86) PCT No.: PCT/EP2016/050129

§ 371 (c)(1),
(2) Date: Apr. 5, 2017

(87) PCT Pub. No.: WO2016/113160

PCT Pub. Date: Jul. 21, 2016

(65) Prior Publication Data

US 2017/0296411 A1 Oct. 19, 2017

(30) Foreign Application Priority Data

Jan. 15, 2015 (DE) ..... 20 2015 100 170 U

(51) Int. Cl.
*A47C 1/00* (2006.01)
*A61G 15/00* (2006.01)
(Continued)

(52) U.S. Cl.
CPC ..... *A61G 5/14* (2013.01); *A47C 1/032* (2013.01); *A47C 3/265* (2013.01); *A61G 5/1059* (2013.01); *A61G 5/1075* (2013.01)

(58) Field of Classification Search
CPC ..... A61G 5/14; A61G 5/1059; A61G 5/1075; A47C 1/032; A47C 3/265
(Continued)

(56) References Cited

U.S. PATENT DOCUMENTS 597,278 A * 1/1898 Fischer et al. ..... A47C 3/24 248/405
2,608,239 A * 8/1952 Gorden ..... A47C 3/24 297/330
(Continued)

FOREIGN PATENT DOCUMENTS

CN 2233696 Y 8/1996
CN 2294717 Y 10/1998
(Continued)

OTHER PUBLICATIONS

International Search Report for corresponding PCT Application No. PCT/EP2016/050129, 4 pages, dated Dec. 4, 2016.

*Primary Examiner* — Mark R Wendell
(74) *Attorney, Agent, or Firm* — Timothy X. Gibson, Esq.; Gibson & Dernier LLP

(57) ABSTRACT

A seating furniture chassis having a height-adjustable seat surface, a drive means, a shaft, a height-adjustment mechanism and a threaded rod, wherein the drive means is coupled to the shaft and is designed to transmit a torque to the threaded rod by means of the shaft, and wherein the height-adjustment mechanism is coupled to the threaded rod and to the seat surface such that a rotation of the threaded rod is converted into a height adjustment of the seat surface by means of the height-adjustment mechanism, characterized in that a longitudinal axis of the shaft is not arranged parallel to a longitudinal axis of the threaded rod.

14 Claims, 1 Drawing Sheet

(51) Int. Cl.

| | |
|---|---|
| ***B60N 2/00*** | (2006.01) |
| ***B60N 2/02*** | (2006.01) |
| ***A61G 5/14*** | (2006.01) |
| ***A61G 5/10*** | (2006.01) |
| ***A47C 1/032*** | (2006.01) |
| ***A47C 3/26*** | (2006.01) |

(58) Field of Classification Search
USPC ..... 297/325
See application file for complete search history.

(56) References Cited

U.S. PATENT DOCUMENTS 3,763,507 A * 10/1973 Propst ..... A47D 7/00 5/100
3,765,720 A * 10/1973 Sakai ..... B60N 2/045 297/330
4,015,812 A 4/1977 Heesch
4,852,939 A * 8/1989 Krauska ..... A47C 1/0242 297/330
4,993,777 A * 2/1991 LaPointe ..... A61G 5/14 297/325
5,165,753 A 11/1992 Henderson
5,556,163 A * 9/1996 Rogers, III ..... A47C 1/023 297/330
5,806,920 A 9/1998 Blount
6,637,818 B2 * 10/2003 Williams ..... A61G 5/14 297/330
6,945,605 B2 * 9/2005 Kinoshita ..... A47C 1/023 297/317
7,341,310 B1 * 3/2008 Ross ..... A47C 3/36 297/344.12
7,482,544 B2 * 1/2009 Gong ..... A61G 5/14 200/1 V
2012/0241234 A1 * 9/2012 Wright ..... A61G 5/1059 180/65.51
2017/0027325 A1 * 2/2017 Probst ..... A47B 9/00

FOREIGN PATENT DOCUMENTS

| | | | |
|---|---|---|---|
| CN | 101214187 | A | 7/2008 |
| CN | 201341635 | Y | 11/2009 |
| CN | 202104564 | U | 1/2012 |
| CN | 203483124 | U | 3/2014 |
| DE | 2101775 | A1 | 7/1972 |
| DE | 2646839 | A1 | 5/1977 |

* cited by examiner

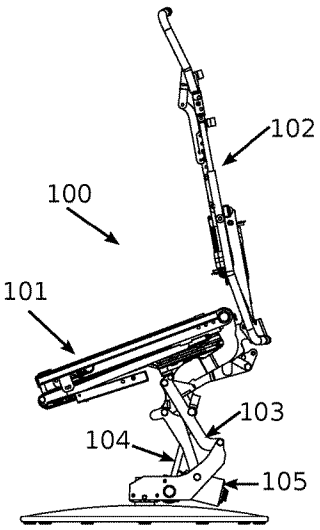
Fig. 1A
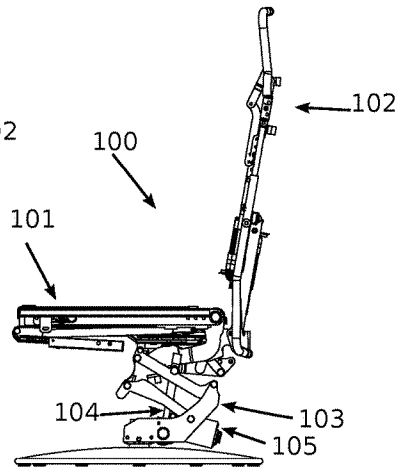
Fig. 1B
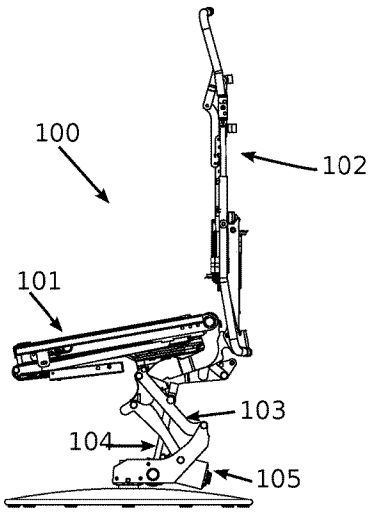
Fig. 1C
Fig. 1D
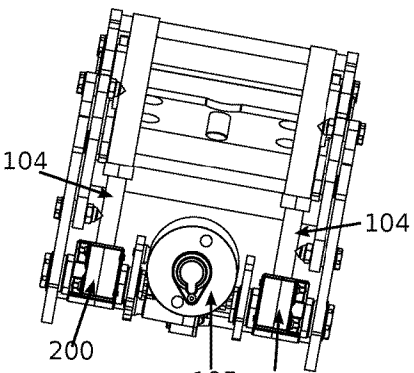
Fig. 2
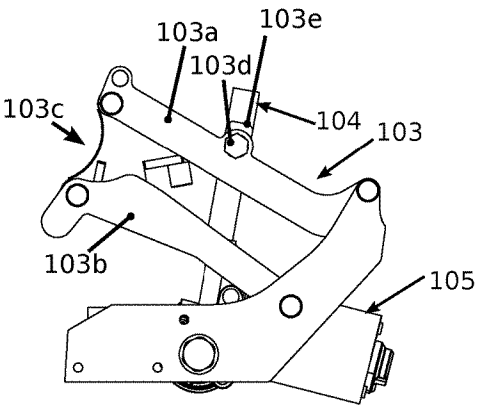
Fig. 3

SEATING FURNITURE CHASSIS HAVING A HEIGHT-ADJUSTMENT SEAT SURFACE

FIELD OF THE INVENTION

The present invention relates to a seating furniture chassis having a height-adjustable seat surface as described herein.

Within the scope of this invention, a seating furniture chassis is understood as a structure which is used as a basic framework of an item of seating furniture. The seating furniture chassis may thus, for example, be a structure made of metal and/or other materials, upholstery, a cover and further components of the item of seating furniture being able to be fastened thereto.

BACKGROUND

A seating furniture chassis having a height-adjustable seat surface is already known from the prior art. The height-adjustable seat surface is advantageous, primarily for physically impaired users. A relatively high seat surface permits easy standing up and sitting down. When the user sits down, the height of the seat surface may be reduced so that a comfortable seating position is able to be adopted.

Known mechanisms require a relatively large amount of constructional space so that the design of such an item of seating furniture is not suitable for some users.

SUMMARY OF THE INVENTION

Accordingly, the object of the invention is to provide a seating furniture chassis having a mechanism requiring less constructional space and an item of seating furniture having such a seating furniture chassis.

This object is achieved by a seating furniture chassis as disclosed herein and an item of seating furniture as disclosed herein. Embodiments of the invention are disclosed herein.

The seating furniture chassis comprises a height-adjustable seat surface, a drive means, a shaft, a height-adjustment mechanism and a threaded rod. The drive means is coupled to the shaft and is designed to transmit a torque to the threaded rod by means of the shaft. The height-adjustment mechanism is thus coupled to the threaded rod and to the seat surface such that a rotation of the threaded rod is converted into a height adjustment of the seat surface by means of the height-adjustment mechanism.

According to the invention, it is provided that a longitudinal axis of the shaft is not arranged parallel to a longitudinal axis of the threaded rod. In this case, the longitudinal axis is respectively understood, in particular, as the axis in which the shaft and/or the threaded rod has the greatest extent. With a rotation of the shaft and/or the threaded rod, the longitudinal axis may extend, for example, in the direction of the angular impulse vector.

The threaded rod may, therefore, be set in rotation by means of the drive means. This rotation triggers a height adjustment of the seat surface.

By the non-parallel arrangement of the two longitudinal axes to one another, constructional space is saved since the two relatively long components do not extend in the same direction.

Tests have surprisingly shown that such an arrangement provides sufficient stability for use in a seat furniture chassis. This was unexpected since with relatively heavy users a huge load acts on the mechanism, in particular when the user sits down on the seat surface.

In height-adjustable table furniture it is already known that the longitudinal axis of the shaft does not extend parallel to the longitudinal axis of the threaded rod. Here, however, this mechanism is not used in order to save constructional space. This is because in table furniture generally sufficient constructional space is available. Moreover, in table furniture, the mechanism is not subjected to comparatively large loads.

According to one embodiment of the invention, the seating furniture chassis may comprise a bevel gear which is coupled to the shaft and the threaded rod, so that the torque is able to be transmitted from the shaft to the threaded rod via the bevel gear. The bevel gear is used since the longitudinal axes of the shaft and the threaded rod are not arranged parallel to one another.

According to one embodiment of the invention, the bevel gear may be configured as an obliquely toothed bevel gear. This has the advantage of improved torque transmission. Before the connection of two teeth is released, two other teeth are already in contact with one another.

According to one embodiment of the invention, the seating furniture chassis may comprise a further threaded rod which is coupled via the shaft to the drive means. The further threaded rod may be configured to be similar or the same as the already previously mentioned threaded rod. The use of the further threaded rod increases the stability of the mechanism.

According to one embodiment of the invention, it is possible that a longitudinal axis of the further threaded rod is not arranged parallel to the longitudinal axis of the shaft. However, it is also possible that the longitudinal axes of the two threaded rods are arranged parallel to one another.

According to one embodiment of the invention, the seating furniture chassis may comprise a further bevel gear which is coupled to the further threaded rod and to the shaft.

According to one embodiment of the invention, the further bevel gear may be configured as an obliquely toothed bevel gear.

According to one embodiment of the invention, the height-adjustment mechanism may be coupled to the threaded rod and the seat surface such that, with a height adjustment of the seat surface, the seat surface is inclined at the same time. This is advantageous, in particular, in order to facilitate the standing up and sitting down of a user.

According to one embodiment of the invention, when the seat surface is lifted, an inclination of the seat surface to the front may be triggered. The term "front" in this case is understood, in particular, as the side of the seating furniture chassis opposing a backrest. An inclination of the seat surface to the front may mean that the front region of the seat surface is lowered relative to the rear region of the seat surface and/or the rear region of the seat surface is lifted relative to the front region of the seat surface.

According to one embodiment of the invention, when the seat surface is lowered, an inclination of the seat surface to the rear may be triggered. An inclination of the seat surface to the rear may mean that the front region of the seat surface is lifted relative to the rear region and/or the rear region of the seat surface is lowered relative to the front region.

According to one embodiment of the invention, the seating furniture chassis may comprise a backrest. The backrest may be coupled to the height-adjustment mechanism, such that the backrest is inclined when the height of the seat surface is adjusted.

According to one embodiment of the invention, when the seat surface is lifted, an inclination of the backrest to the front may be triggered. An inclination of the backrest to the front may mean that an upper region of the backrest is moved to the front and/or a lower region of the backrest is moved to the rear.

According to one embodiment of the invention, when the seat surface is lowered, an inclination of the backrest to the rear may be triggered. An inclination of the backrest to the rear may mean that an upper region of the backrest is moved to the rear and/or a lower region of the backrest is moved to the front.

According to one embodiment of the invention, the longitudinal axis of the shaft may be arranged approximately at right angles to the longitudinal axis of the threaded rod. This arrangement is particularly space-saving.

BRIEF DESCRIPTION OF THE DRAWINGS

Further features and advantages of the present invention will become clear with reference to the following description of preferred exemplary embodiments with reference to the accompanying drawings. In this case, the same reference numerals are used for the same or similar components and for components having the same or similar functions. In the drawings:

FIG. 1 show schematic views of a seating furniture A-D chassis according to an embodiment of the invention;

FIG. 2 shows a schematic view of the drive means, the threaded rods and the bevel gear from the rear face of the seating furniture chassis; and FIG. 3 shows a schematic view of the drive means, one of the threaded rods and the height-adjustment means in a side view.

DETAILED DESCRIPTION OF THE INVENTION

The seating furniture chassis 100 comprises a height-adjustable seat surface 101 and a backrest 102. The seat surface 101 is coupled to a height-adjustment mechanism 103 which in turn is coupled to threaded rods 104. The threaded rods 104 may be set in rotation by means of a drive means 105. With the rotation of the threaded rods 104, the height of the seat surface 101 is altered. This is able to be seen particularly clearly in FIGS. 1A to 1D.

With a height adjustment of the seat surface 101, the seat surface 101 is inclined at the same time. If the seat surface 101 is lowered, the region of the seat surface facing the backrest 102 is inclined downwardly relative to the region remote from the backrest 102. If the seat surface 101 is lifted, the region of the seat surface facing the backrest 102 is inclined upwardly relative to the region remote from the backrest 102.

Moreover, the backrest 102 is inclined when the height of the seat surface 101 is adjusted. An upper region of the backrest 102 is moved to the front relative to a lower region of the backrest 102 when the seat surface 101 is lifted. When the seat surface 101 is lowered, the upper region of the backrest 102 is moved to the rear relative to the lower region of the backrest 102.

The drive means 105 sets a shaft (not shown) in rotation. The longitudinal axis of the shaft in this case extends horizontally from one side of the seating furniture chassis to the side of the seating furniture chassis opposing this side. The sides are in this case the sides arranged on the right and left in the usual position of use of the seating furniture chassis. These are the sides on which neither the backrest is arranged nor those sides opposing the backrest.

The rotation of the shaft is transmitted by means of bevel gear 200 to the threaded rods 104. Therefore, it is possible that the longitudinal axes of the threaded rods 104 do not extend parallel to the longitudinal axis of the shaft. In particular, in FIG. 2 it may be seen that the longitudinal axes of the threaded rods 104 extend approximately at right angles to the longitudinal axis of the shaft.

In FIG. 3 it is shown how the height-adjustment mechanism 103 is coupled to the threaded rods 104, so that a rotation of the threaded rods 104 results in a height adjustment of the seat surface 101.

The height-adjustment mechanism 103 comprises a first strut 103*a*, a second strut 103*b*, a flexible connecting member 103*c*, a screw 103*d* and a threaded element 103*e*. The first strut 103*a* is connected to the second strut 103*b* via the flexible connecting member 103*c*. The first strut 103*a* is connected to the threaded element 103*e* via the screw 103*d*. The threaded element is fixed on the threaded rod 104.

When the threaded rod 104 is turned in order to adjust the height of the seat surface 101, the threaded element 103*e* is moved upwards or downwards. The screw 103*d* is moved in the same direction and the first strut 103*a* pivots leading to a height adjustment of the seat surface 101. The second strut 103*b* also pivots due to its connection to the first strut 103*a* via the connecting member 103*c*. This leads to an inclination of the seat surface 101.

What is claimed is:

1. A seating furniture chassis having a height-adjustable seat surface, a drive means, a shaft, a height-adjustment mechanism and a threaded rod, wherein the drive means is coupled to the shaft and is designed to transmit a torque to the threaded rod by means of the shaft, and wherein the height-adjustment mechanism is coupled to the threaded rod and to the seat surface such that a rotation of the threaded rod is converted into a height adjustment of the seat surface by means of the height-adjustment mechanism, and such that with a height adjustment of the seat surface, the seat surface is inclined at the same time, characterized in that a longitudinal axis of the shaft is not arranged parallel to a longitudinal axis of the threaded rod.

2. The seating furniture chassis of claim 1, wherein the seating furniture chassis comprises a bevel gear which is coupled to the shaft and the threaded rod, so that the torque is able to be transmitted from the shaft to the threaded rod via the bevel gear.

3. The seating furniture chassis of claim 2, wherein the bevel gear is configured as an obliquely toothed bevel gear.

4. The seating furniture chassis of claim 1, wherein the seating furniture chassis comprises a further threaded rod which is coupled via the shaft to the drive means.

5. The seating furniture chassis of claim 4, wherein a longitudinal axis of the further threaded rod is not arranged parallel to the longitudinal axis of the shaft.

6. The seating furniture chassis of claim 4, wherein the seating furniture chassis comprises a further bevel gear which is coupled to the further threaded rod and to the shaft.

7. The seating furniture chassis of claim 6, wherein the further bevel gear is configured as an obliquely toothed bevel gear.

8. The seating furniture chassis of claim 1, wherein when the seat surface is lifted, an inclination of the seat surface to the front is triggered.

9. The seating furniture chassis of claim 1, wherein when the seat surface is lowered, an inclination of the seat surface to the rear is triggered.

10. The seating furniture chassis of claim 1, wherein the seating furniture chassis comprises a backrest, wherein the backrest is coupled to the height-adjustment mechanism, such that the backrest is inclined when the height of the seat surface is adjusted.

11. The seating furniture chassis of claim 10, wherein when the seat surface is lifted, an inclination of the backrest to the front is triggered.

12. The seating furniture chassis of claim 10, wherein when the seat surface is lowered, an inclination of the backrest to the rear is triggered.

13. The seating furniture chassis of claim 1, wherein the longitudinal axis of the shaft is arranged approximately at right angles to the longitudinal axis of the threaded rod.

14. An item of seating furniture, comprising a seating furniture chassis of claim 1.

* * * * *